United States Patent [19]

Stickler

[11] Patent Number: 4,834,450

[45] Date of Patent: May 30, 1989

[54] TOTE-TABLE

[76] Inventor: Rexford W. Stickler, R.D. 1 Box 77, Wellsburg, N.Y. 14894-9748

[21] Appl. No.: 141,577

[22] Filed: Jan. 7, 1988

[51] Int. Cl.[4] ..... A47B 39/00

[52] U.S. Cl. ..... 297/157; 108/69; 108/90; 108/111; 297/17; 297/442

[58] Field of Search ..... 297/157, 159, 442, 17; 108/111, 69, 89, 90, 153

[56] References Cited

U.S. PATENT DOCUMENTS

| | | | |
|---|---|---|---|
| 2,099,745 | 11/1937 | Lykins . | |
| 2,512,473 | 6/1950 | Alch | 297/159 |
| 2,522,774 | 9/1950 | Bower | 297/442 X |
| 2,653,652 | 9/1953 | DeMartini . | |
| 3,262,405 | 7/1966 | Sutton | 108/153 |
| 3,300,245 | 1/1967 | Rumble | 297/157 |
| 3,475,050 | 10/1969 | Leahy | 297/17 |
| 3,514,154 | 5/1970 | Kotler | 297/159 |
| 3,695,703 | 10/1972 | Notko | 297/442 |
| 4,076,305 | 2/1978 | Sullivan | 297/157 |
| 4,223,945 | 9/1980 | Nikitits . | |
| 4,415,199 | 11/1983 | Wright . | |
| 4,433,753 | 2/1984 | Watson | 297/442 X |
| 4,506,466 | 3/1985 | Hall | 108/111 X |
| 4,537,443 | 8/1985 | Bray . | |
| 4,700,986 | 10/1987 | Davis et al. | 297/157 |

FOREIGN PATENT DOCUMENTS

| | | | |
|---|---|---|---|
| 782215 | 9/1957 | United Kingdom | 297/17 |
| A2015934 | 9/1979 | United Kingdom | 297/157 |

*Primary Examiner*—Peter A. Aschenbrenner
*Assistant Examiner*—Thomas A. Rendos
*Attorney, Agent, or Firm*—Ralph R. Barnard

[57] ABSTRACT

A combined table and bench assembly for indoor and outdoor use, capable of being assembled and disassembled without tools. The component parts of the assembly fit together solely with interlocking notches and/or protrusions. The assembly is sturdy and will withstand rugged use. Yet, it is light enough to be easily transported. The parts of the assembly may be conveniently stored and transported in a compact wheeled carrier.

4 Claims, 3 Drawing Sheets

TOTE-TABLE

FIELD OF THE INVENTION

The invention relates in general to the field of tables and chairs for picnicking and camping and more particularily to a combined table and bench assembly capable of being assembled and disassembled without tools.

DESCRIPTION OF THE PRIOR ART

Many types of collapsible, foldable, and/or detachable table and chair assemblies for both indoor and outdoor occasional use have been taught by the prior art. Such an assembly may be used, indoors or outdoors, for additional dining space for extra guests, as an extra table and seating for board game playing, for camping, for roadside dining while traveling, for balcony or patio use, or for picnicking. For example, it is frequently difficult to find a picnic table at a desirable location on a beautiful day.

Folding or collapsible table and chair/bench assemblies have seemingly been designed for the sole purpose of making a compact unit for storage, rather than for the dual purposes of comfort as well as compactness. Other types of assemblies may be comfortable, but frequently they are also large and bulky and therefore problematic in terms of both storage and transportation. Furthermore, these units often require the use of hinges and/or pins which are not very practical for rugged outdoor use such as picnicking and camping. Hinges eventually become rusted and difficult to move and pins tend to get lost. Additionally, folding tables with hinges lack stability particularily on uneven ground surfaces. Moreover, if the unit is strong and sturdy, it is usually too heavy to be conveniently and frequently moved.

Detachable table and chair/bench units often require bolts, nuts, or screws, and tools for assembly. Thus, assembly and disassembly are not quickly or easily accomplised, and injury may be caused by the tools. Furthermore, once the unit has been taken apart, the smaller components are easily lost and it is frequently difficult to remember how to reassemble the unit correctly without instructions (which inevitably disappear).

While many of the folding, collapsible, or detachable table and chair units taught by the prior art are meant to be portable, few make it far from the closet where they are stored. Generally they are bulky and/or heavy and not easily transported.

It is the primary object of the present invention to provide a combined table and bench assembly capable of being assembled and disassembled without tools.

It is a further object of the present invention to provide a combined table and bench assembly made up of parts which fit together solely by means of interlocking notches and/or protrusions.

It is a further object of the present invention to provide a combined table and bench assembly which is sturdy when used, but which is easily disassembled for storage, and which is fully portable.

SUMMARY OF THE INVENTION

The present invention overcomes the problems and disadvantages of the prior art by providing a combined table and bench assembly which is sturdy, easily assembled without tools, and fully portable. It enables the user to have a comfortable meal, indoors or outdoors, at the place of his choice.

The novelty of the invention disclosed herein is that it is made up of components which are fitted together solely with interlocking notches and/or protrusions. The advantages of such an invention will be obvious to one skilled in the art. Among other advantages of a notched interlocking assembly is the fact that each of the crossed interlocking notches lends stability to the entire assembly. Unlike other portable table and bench assemblies, the present invention will not accidentally fold up or collapse, since none of the parts are designed to fold or collapse. Moreover, because no additional cross braces are required, there is no interference with comfortable seating. Often, such cross braces tend to interfere with leg space under the table and/or benches. Thus, the result of the present invention is a combined table and chair assembly which is sturdy, comfortable, compact, and which is easily assembled without tools.

The components parts of the invention may be conveniently stacked vertically within a wheeled frame. In such a position they work in combination with the frame to form a completely portable rectangular unit which occupies a minimal amount of space. The carrier is mounted on wheels to provide convenient transportation of the unit across parking lots, pavement, and grass. Therefore, the present invention is not only compact when disassembled, but also completely portable.

DESCRIPTION OF THE PREFERRED EMBODIMENT

The invention is illustrated in its preferred embodiment. In each figure the reference numbers are the same, thus each number always refers to the same part.

Figure 1:
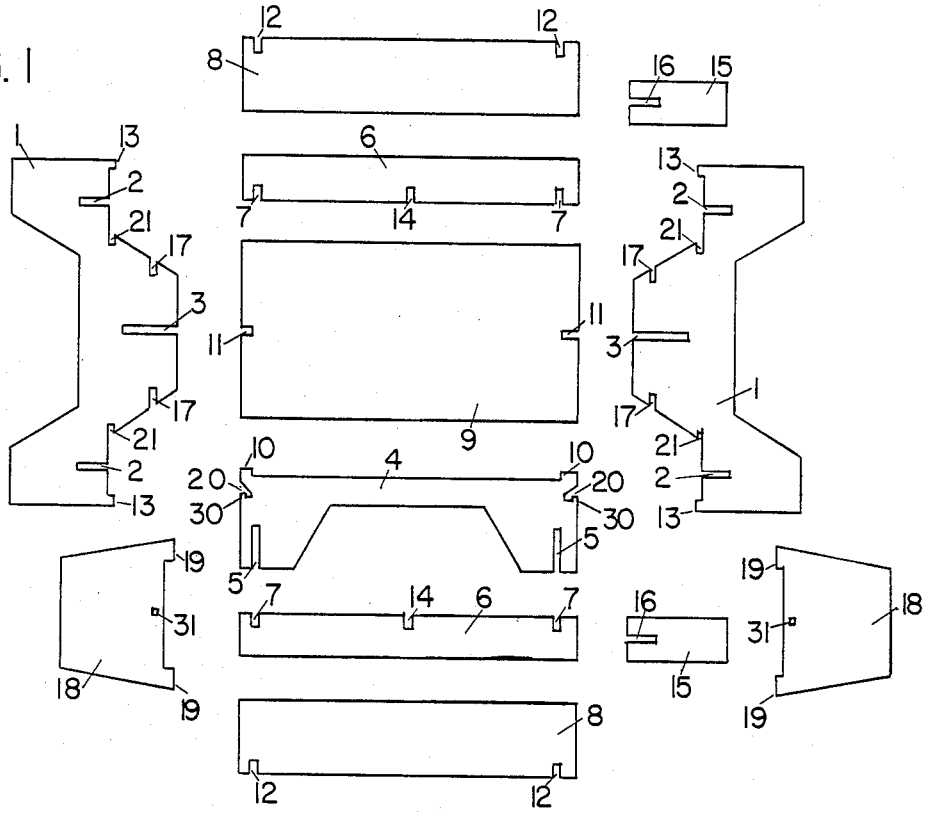
FIG. 1 is a top view of all of the component parts laid out horizontally.
Figure 2:
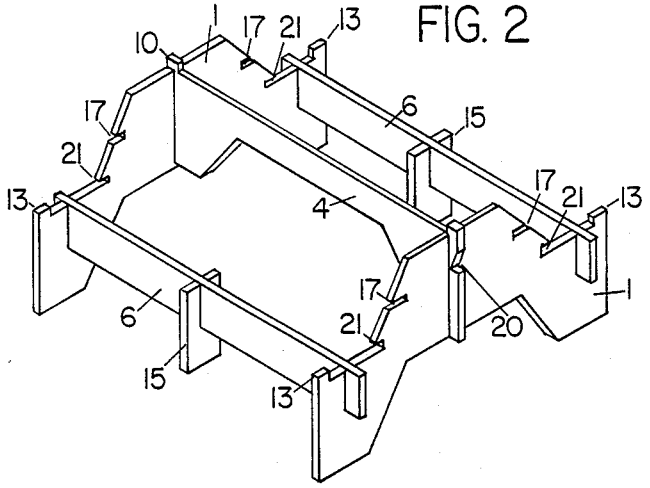
FIG. 2 is a perspective view illustrating the support structure of the preferred embodiment.

Referring now to the drawings, FIG. 1 shows the details of the component parts of the preferred embodiment of the invention. The combined table and the bench assembly is easily put together by interlocking the corresponding notches of the component parts. There is no set order in which the components must be attached, but the following order is logical and known to be acceptable in assembling the present invention. The center support (4) is attached to the end supports (1) by interlocking the vertical notches (5) of the center support with the vertical notch (3) of each of the end supports. The seat support (6) is then attached to the seat support reinforcement member (15) by interlocking vertical notch (16) of the reinforcement with the vertical notch (14) of the seat support. Both seat supports (6) with their respective reinforcements are then attached to each of the end supports by means of interlocking the vertical notch (2) of each of the end supports with the vertical notch (7) of the seat support. At this point, the support structure of the invention is complete as seen in FIG. 2.

The addition of the seat support reinforcement members (15) to the seat supports (6) is not essential to the invention, but rather a refinement. On the one hand, for example, the seat support reinforcement members would not be necessary when the seat supports are relatively short. In such a case, the seat supports could be directly attached to the end supports (1). However, if on the other hand, the seat supports were made significantly longer, additional seat support reinforcement members would be necessary.

Figure 4:
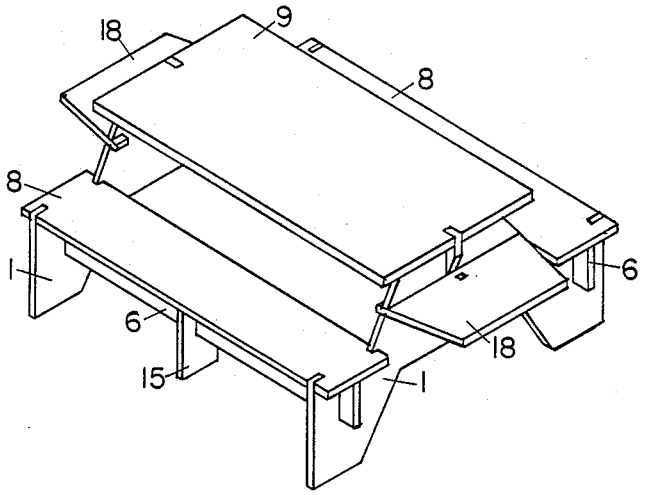
FIG. 4 is a perspective view of the assembled table and benches.
Figure 3:
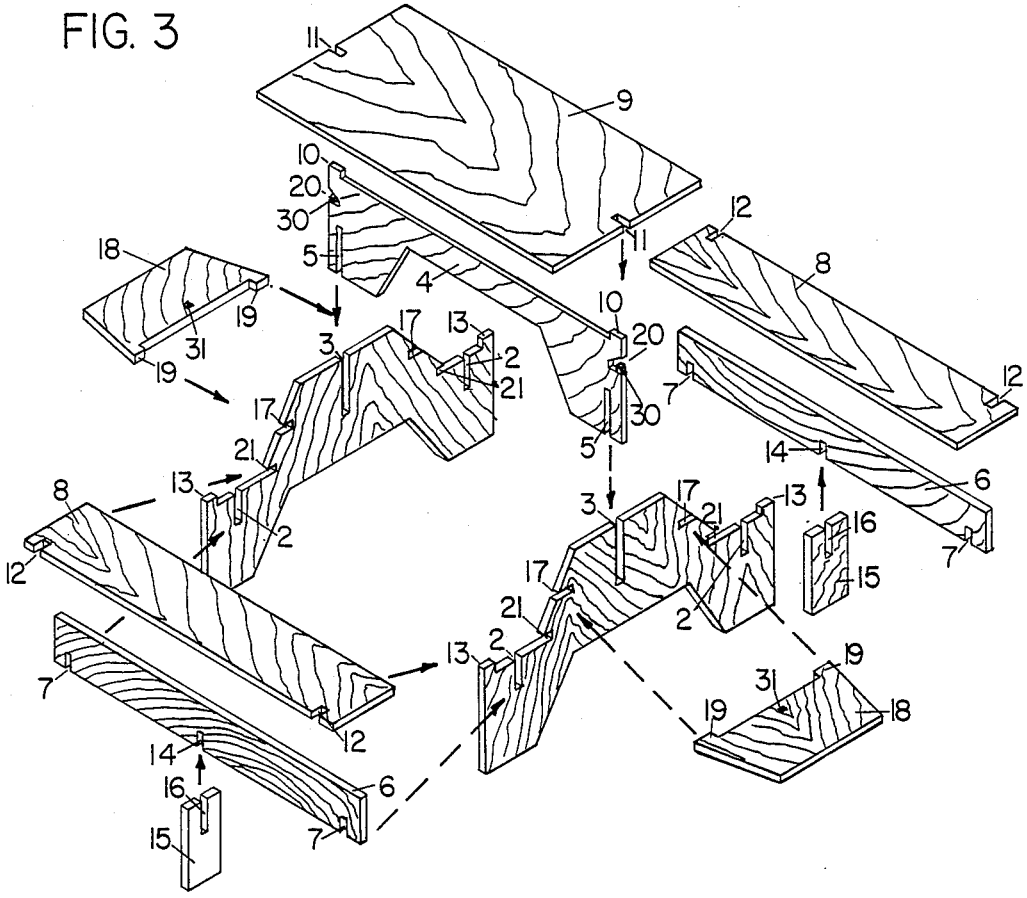
FIG. 3 illustrates the overall manner in which the component parts of the table and bench assembly are arranged with respect to each other.

FIG. 3 illustrates the addition of the seat boards (8) which slide into horizontal notches (21) of the end support boards (1). The opposite side of the seat board (8) having notches (12) interlocking with the protrusions (13) of the end support board (1). The table top (9) is sized to simultaneously rest on the top of each of the notched end supports (1) and the notched center support (4). In FIG. 4, it is shown with notches (11) interlocked with the protrusions (10) of the center support (4). The table top (9) may be designed with built-in drink holders by simply cutting out circular holes in the corners of the table top for the purpose of guarding against windblown cups and inadvertantly spilled drinks.

The end tables (18) are attached to the horizontal notches (17) of the end supports (1) by means of protrusions (19) extending from both ends of one side of each of the end tables (18). The horizontal notch (20) in the center support (4) is designed to receive and support an end table (18). The bottom of horizontal notches (20) of each center support (4) have a protrusion (30) which engages with a receiving hole (31) located in each of the end table members (18). The end tables may be used to ease congestion on the table top.

Disassembly of the table and bench assembly may be accomplished by using a procedure opposite to that above described.

The proportions of the table and bench assembly herein described may vary within the spirit of the invention, keeping the size of the human body in mind. For example, to comfortably seat four (4) adults, the table top may be two feet by four feet and located on end supports at a height of twenty-seven inches. The end supports, center support, seat boards, seat supports, and carrier would likewise be proportionally made at four feet in length.

There are certain minimum dimensions that a person supplying the teaching of the present invention should keep in mind. These dimensions are based on several important considerations: The table and benches must have the relative dimensions to fit an average sized person comfortably; the dimensions must provide the necessary rigidity of the components when assembled; the dimensions must relate such that the parts fit into a minimum rigid package.

Keeping the above considerations in mind, the assembly may be made smaller to seat only two people. However, the table top must remain at least twenty-four inches wide to allow knee space for both people seated on opposite sides of the table. Minimally, the table length could be decreased to a size just large enough to accomodate one person on each side. The decrease in the table top length would be proportionately matched by a decrease in the center support, seat boards, and seat supports. The end supports could not be so decreased, because the end supports vary with the table width, which as stated above, may not decrease. Therefore, the carrier would remain the same proportions as it would for a four-seater unit.

The whole assembly may be made larger to seat more than four people, but some additions are required. More notched seat support reinforcements (15) may be required and a correspondingly larger carrier (22) would also be necessary. As the size of the table increases, the carrier must increase in direct proportion. Therefore, at some point, the spirit of the invention would be defeated by increasing the size of the table, since the unit would be cumbersome rather than convenient and compact as originally designed.

It is to be noted that the invention is not to be limited to the above and below described sizes or materials. The given sizes and materials are by way of an example only. A model has been made in accordance with the example described and has been shown to seat and support four full-sized adults while being sufficiently compact and portable when disassembled. While three-quarter inch plywood was the material used by the inventor in his model, other types of material and other thicknesses may be used in the spirit of the present invention. One example is that the plywood could be dipped in plastic coating for finishing and for water proofing. The size and type of material which may be used is limited by its strength, rigidity, and appropriateness.

A carrier for the component parts of the present invention is particularily important because of the likelihood that the parts will become unintentionally detached when moved, unless carried in a particular way. The interlocking notches function under the stress of the interlocking parts. Unless the table and benches assembly is carefully lifted by two people, each grasping one of the end support boards, the assembly will come apart. Therefore, the invention as disclosed is made portable by a wheeled carrier (22).

Figure 5:
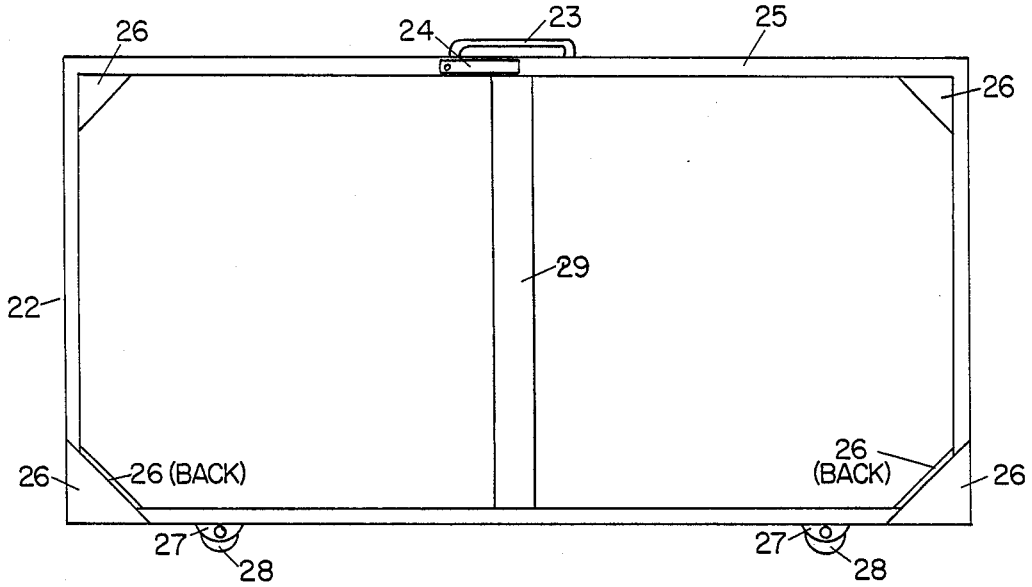
FIG. 5 is a perspective view showing the wheeled frame which combines with the table and bench assembly to form a carrying unit.

FIG. 5 shows the wheeled carrier generally (22) without the component part of the chair and bench assembly. A handle (23) is attached to the top part of the rectangular frame (25) for the purpose of pulling the unit. One side of the frame contains a vertical supporting board (29) which helps keep the component parts of the invention within the frame during storage and which lends structural support to the rectangular frame (25). Stops (26) are placed diagonally at the corners of the frame for the purpose of holding the components parts within. Wheel attachment means (27) connect the wheels (28) to the bottom of the rectangular frame (25).

Figure 6:
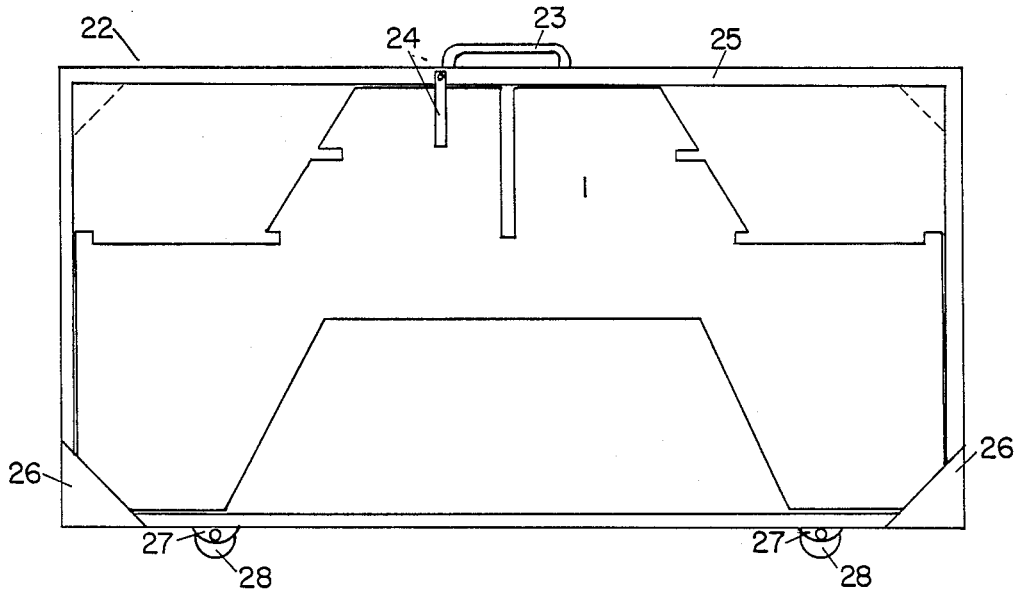
FIG. 6 is a side view of the wheeled carrier containing all of the components parts of the combined table and bench assembly.

FIG. 6 illustrates the inventive tables and bench assembly in its storage and transportation mode, with all of its components disassembled. One of the end support boards (1) is shown in the forefront, holding the remaining components within. A lever (24) locks the component parts of the table and bench assembly within the rectangular frame (25) as it is moved from its horizontal position, as shown in FIG. 5, to a vertical position, as shown in FIG. 6. The table top (9) holds the components from the far side (not shown). Either the end support or the table top may be used in either the front or back, as long as there is one at each position to hold the component parts from falling out of the frame. The frame of the carrier (25) may be padded on the outside with material such as rubber, attached in a manner so that the carrier can be laid down and stored without sliding on or scratching the surface upon which it is laid.

Accordingly, it is to be understood that the embodiments of the invention herein described are merely illustrative of the appliction of the principles of the invention. Reference herein to details of the illustrated embodiment are not intended to limit the scope of the claims, which themselves recite those features regarded as essential to the invention.

I claim:

1. A combined table and bench assembly, comprising:

(a) a pair of parallel spaced end support boards each having at least three (3) vertical notches, two (2) of which have identical function relating to seat supports, the other of which, located near the top center of each of said end support boards, relates to a center support and two (2) horizontal notches and two (2) vertical protrusions located to receive a seat board with one vertical protrusion functioning with one horizontal notch for each seat board;

(b) a center support having a vertical notch at each extremity thereof so as to function in an interlocking relationship with the top center of each of said end support boards within its related vertical notch;

(c) a pair of seat supports vertically notched at each extremity for being in interlocking relationship with the vertical notches of each of said end support boards within its related vertical notch;

(d) a pair of seat boards each horizontally laying simultaneously upon one of the said notched seat supports and said notched end supports;

(e) a table top sized to simutaneously rest on the top of each of said notched end supports and said notched center support;

(f) said center support has a vertical protrusion on each end thereof and said table top has a notch on each end thereof that interlocks with the said protrusion of said center support, thereby adding rigidity to the assembly;

(g) each of said seat boards being notched to fit interlocking with horizontal notches of and abut against vertical protrusions of each of said end support boards;

(h) a notched seat support reinforcement member for cooperating with each of said seat supports, wherein each of said seat supports has an additional vertical notch so as to function in an interlocking relationship with said seat support reinforcement member, thereby adding stability to the assembly;

(i) all of the said components fit together as stated solely with said interlocking notches and/or said protrusions.

2. The combined table and bench assembly of claim 1 including an end table member for cooperating with each of said end support boards having a receiving hole and having protrusions on each end of its longer side, wherein each of said end support boards has a pair of horizontal notches for the purpose of fitting in interlocking relationship with said protrusions of said end table member, and wherein said notched center support has a horizontal notch at each extremity to receive and to support said end table, and wherein said horizontal notch at each extremity of each of said notched center supports has a protrusion which engages with said receiving hole of like shape located in each of said end table members.

3. The table and bench assembly of claim 1 in combination with a wheeled carrier, comprising:

said table top is at least about 24 inches in width and 48 inches in length;

said two end support boards are at least about 48 inches in width and at least about 24 inches in height;

said center support board, seat boards, and seat support boards are at least about 48 inches long;

all of said boards having the same long dimension;

a carrier in the form of a frame on wheels for carrying the component parts, and sized to receive both the table top and the two end support boards and the other components and having latch means to contain the component parts within the frame.

4. A combined table and bench assembly, comprising:

(a) a pair of parallel spaced end support boards each having at least three (3) vertical notches, two (2) of which have identical function relating to seat supports, the other of which, located near the top center of each of said end support boards, relates to a center support and two (2) horizontal notches and two (2) vertical protrusions located to receive a seat board with one vertical protrusion functioning with one horizontal notch for each seal board;

(b) a center support having a vertical notch at each extremity thereof so as to function in an interlocking relationship with the top center of each of said end support boards within its related vertical notch;

(c) a pair of seat supports vertically notched at each extremity for being in interlocking relationship with the vertical notches of each of said end support boards within its related vertical notch;

(d) a pair of seat boards each horizontally laying simultaneously upon one of the said notched seat supports and said notched end supports:

(e) a table top sized to simultaneously rest on the top of each of said notched end supports and said notched center support;

(f) said center support has a vertical protrusion on each end thereof and said table top has a notch on each end thereof that interlocks with the said protrusion of said center support, thereby adding rigidity to the assembly;

(g) each of said seat boards being notched to fit interlocking with horizontal notches of and abut against vertical protrusions of each of said end support boards;

(h) a notched seat support reinforcement member for cooperating with each of said seat supports, wherein each of said seat supports has an additional vertical notch so as to function in an interlocking relationship with said seat support reinforcement member, thereby adding stability to the assembly;

(i) all of the said components fit together as stated solely with said interlocking notches and/or said protrusions; and, (j) an end table member for cooperating with each of said end support boards having a receiving hole and having protrusions on each end of its longer side, wherein each of said end support boards has a pair of horizontal notches for the purpose of fitting in interlocking relationship with said protrusions of said end table member, and wherein said notched center support has a horizontal notch at each extremity to receive and to support said end table, and wherein said horizontal notch at each extremity of each of said notched center supports has a protrusion which engages with said receiving hole of like shape located in each of said end table members.

* * * * *